US005974849A

United States Patent [19]

Dixon

[11] Patent Number: 5,974,849

[45] Date of Patent: Nov. 2, 1999

[54] CORNER BEAD STRIP TOOL

[76] Inventor: William Dixon, 631 Brunswick Pike, Lambertville, N.J. 08530

[21] Appl. No.: 09/103,102

[22] Filed: Jun. 23, 1998

[51] Int. Cl.[6] ..... B21D 5/08

[52] U.S. Cl. ..... 72/181; 72/179; 72/379.2

[58] Field of Search ..... 72/179, 181, 182, 72/176, 379.2

[56] References Cited

U.S. PATENT DOCUMENTS

| | | | |
|---|---|---|---|
| 420,576 | 2/1890 | Heesom | 72/176 |
| 526,714 | 10/1894 | Henning | 72/181 |
| 867,417 | 10/1907 | Riley . | |
| 1,470,399 | 10/1923 | Smith . | |
| 1,880,246 | 10/1932 | Greiner . | |
| 2,164,836 | 7/1939 | Penkala | 72/181 |
| 3,333,451 | 8/1967 | Inlow | 72/179 |
| 3,610,019 | 10/1971 | Denninger | 72/386 |
| 4,848,126 | 7/1989 | Fryfogle | 72/176 |

FOREIGN PATENT DOCUMENTS

| | | | |
|---|---|---|---|
| 44772 | 11/1931 | Denmark | 72/182 |
| 444469 | 3/1936 | United Kingdom | 72/181 |

*Primary Examiner*—Daniel C. Crane
*Attorney, Agent, or Firm*—Kenneth P. Glynn, Esq.

[57] ABSTRACT

The present invention is a tool for manually altering the angle of a sheetrock corner bead strip from approximately 90° to an angle larger than 90°. The tool includes a main frame having a base and opposing side walls. The main frame is adapted to receive and hold axles for at least two spreader wheels and at least two corner holder wheels. The spreader wheels with axles are mounted in series alignment with one another for rotation within the main frame and the corner holder wheels with axles are also mounted in series for rotation within the main frame. The spreader wheels and the corner holder wheels are all located in a single plane. In a preferred embodiment, the spreader wheels have walls which form truncated V-shaped sides for maintaining a predetermined angle. In another preferred embodiment, the predetermined angle is approximately 120° or approximately 135° and the truncated V-shaped sides correspondingly form an angle of approximately 120° or approximately 135°.

14 Claims, 2 Drawing Sheets

CORNER BEAD STRIP TOOL

BACKGROUND OF THE INVENTION

1. Field of the Invention

The present invention involves a tool for manually altering the angle of a sheetrock corner bead strip. More specifically, the tool has been developed for changing a standard 90° corner bead strip to angles greater than 90°, e.g., suitable for reverse 45° wall angles, i.e. where the wallboard has an angle of approximately 135°. The tool relies upon a plurality of in-series spreader wheels and in-series corner holder wheels to cause the angle of the bead strip to be altered. The tool may be held in one hand and the bead strip pulled through the tool with the other hand to accomplish the angle change.

2. Information Disclosure Statement

The advent of sheetrock for finishing home interior walls brought with it a new trade and new construction methods. To strengthen the sheetrock or plasterboard on the corners where no finishing trim is applied, corner bead strips are used. These are typically somewhat resilient strip metal products running in various lengths, e.g. just under eight feet, and formed approximately 88° to 90° angles, to be used on typical true 90° corners. These bead strips are usually perforated to enhance installation and may be nailed in place and then spackled, sanded and painted.

The standard bead strips are formed at about 90°. While this may be advantageous for the typical corner, bold interior designs as well as reconstruction of existing structures presents problems with non-90° wall junctures. For example, they may be reverse 15° angle walls, i.e. walls at 105°, reverse 30° angle walls, i.e. walls at 120° angles, reverse 45° walls, i.e. at 135°. Usually, these non-90° angles are consistent for the height of a wall juncture and an entire height of bead strip must be "spread" or "squeezed" to form the new angle. When this is done by hand without tools, the results are irregular and inaccurate. On the walls, such bad strips need extra nailing and/or spackle and may bulge or wave. Thus, the effort is very time consuming with disappointing results. The present invention tool has been developed so as to cut down substantially on time to do the job, eliminate sore hands of the workers, avoid inaccuracies, extra nailing and/or spackle, and eliminate disappointing and inferior finished results.

Some strip benders have been developed in the past, but create their own difficulties for the user. Other types of bending tools such as fender tools and sheet metal bending tools have also been developed. For example, U.S. Pat. No. 1,880,246 describes a fender tool using opposing wheels contained in a U-shaped frame for drawing sheet metal therethrough to reshape the metal. This device exposes the metal in that one edge is exposed while the metal is being formed, and a singe set of wheels with curved surfaces are used, whereas the present invention includes a plurality of wheels, which retain, shape, guide, maintain alignment and produce straight line angle changes. In addition, U.S. Pat. Nos. 3,610,019; 1,470,399 and 867,417 all describe bending machines to change the shape of a strip of metal across its width, but do not show any of the critical structural features of the present invention. In fact, none of the above prior art references teach or render the present invention obvious, utilizing a hand-held tool which eliminates the aforementioned difficulties.

SUMMARY OF THE INVENTION

The present invention involves a tool for manually altering the angle of a sheetrock corner bead strip from approximately 90° to an angle larger than 90°. The tool includes a main frame having a generally U-shaped configuration with a base and opposing side walls. The main frame is adapted to receive and hold axles for at least two spreader wheels and at least two corner holder wheels. At least two spreader wheels with axles are mounted in series alignment with one another for rotation of the spreader wheels within the main frame and at least two corner holder wheels with axles are mounted in series alignment with one another for rotation of the corner holder wheels within the main frame. The spreader wheels and the corner holder wheels are all located in a single plane. In a preferred embodiment, the spreader wheels have walls which form truncated V-shaped sides for maintaining a sheetrock corner bead strip at a predetermined angle within the tool. In another preferred embodiment, the predetermined angle is approximately 120° or approximately 135° and the truncated V-shaped sides correspondingly form an angle of approximately 120° or approximately 135°.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention tool is a device for altering the angle of a sheetrock corner bead strip. By "sheetrock corner bead strip" is meant any bendable corner strip or angle strip used to finish off sheetrock, plasterboard, plaster, paneling, tile or the like. Such strips are thin metal and the final use may be underneath spackle or a finished metal strip used on the outside of panelling, e.g. on inside or outside corners. Such strips typically are sold with 90° angles and the present invention permits the orderly, accurate, efficient and high quality creation of non-90° angles. Advantageously, the tool of the present invention is hand held, yet eliminates difficulties and irregularities which occur with previously developed devices.

Figure 1:
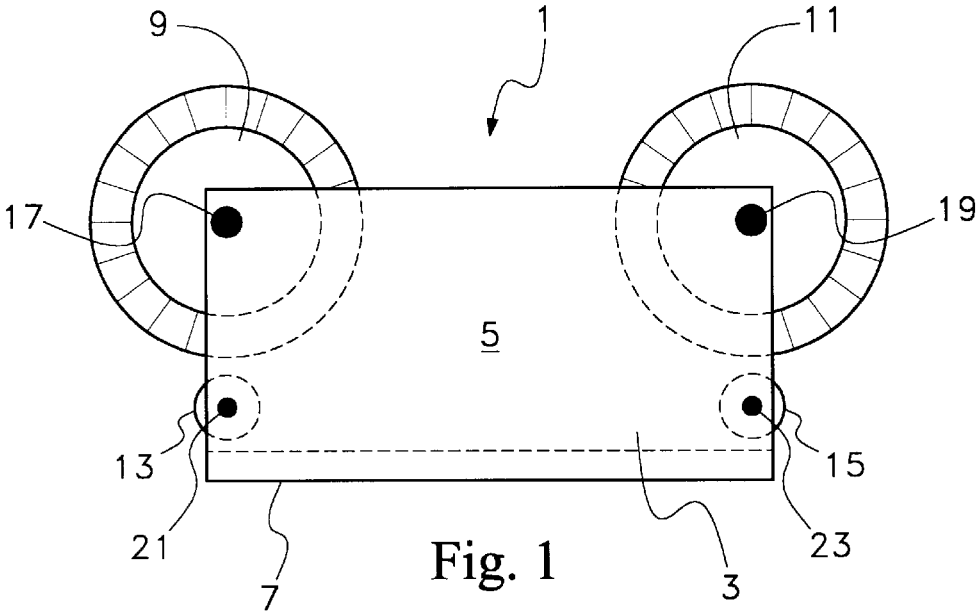
FIG. 1 is a side view of a present invention tool with two pairs of wheels.
Figure 2:
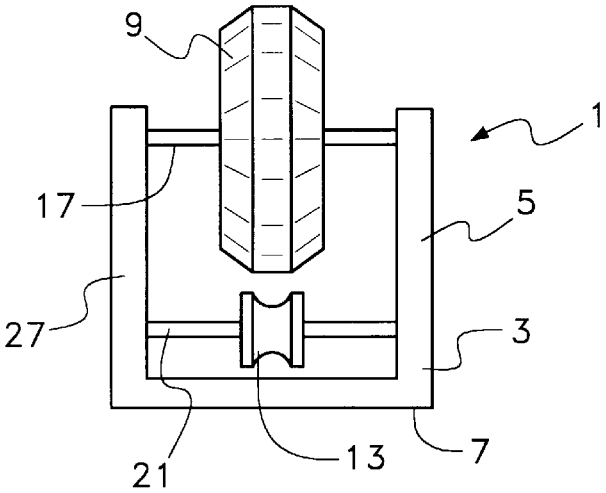
FIG. 2 is a front view of the present invention tool shown in FIG. 1.

Referring now to FIGS. 1 and 2 together, FIG. 1 shows a side view and FIG. 2 shows a front view of present invention tool 1. Tool 1 includes a main frame 3 which is constructed of side walls 5 and 27 and base or bottom 7. At the lower aspects of side walls 27 and 5 are holes which contain axles 21 and 23. These axles have corner bead corner holder wheels 13 and 15. At the upper aspects of side walls 5 and 27 are holes for axles 17 and 19 which contain spreader wheels 9 and 11. The axles 17, 19, 21 and 23 may be force-fitted, capped, flared, screwed in at one end from the other side or otherwise mounted in any conventional matter. The wheels 9, 11, 13 and 15 are centrally located on their respective axles and do not slide left or right but are in a fixed, rotatable position.

Figure 3:
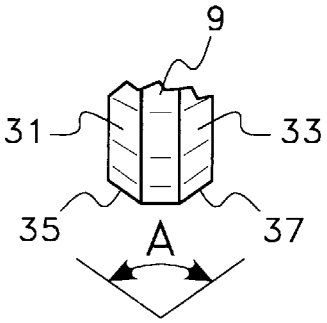
FIG. 3 is a partial front view of a spreader wheel utilized in a present invention tool.

FIG. 3 shows a partial front view of spreader wheel 9. This includes a truncated V profile and has tapered edges to form the truncated V shown as tapers 31 and 33. The bottom portion edge of those tapers are indicated as bottom edges 35 and 37. They form angle A which could be 105°, 125°, 135° or any other desired angle. The flap in the middle is not essential and it could be a complete V although the flat area allows for more pressure on the outer portions of the bead strip as it passes through the present invention tool.

Figure 4:
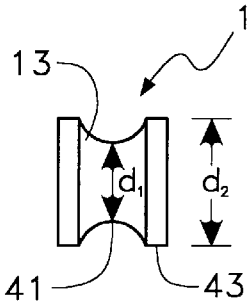
FIG. 4 is a front view of a corner holder wheel utilized in a present invention tool.

FIG. 4 shows a front view of corner holder wheel 13 and this has a center diameter D1 and an outer diameter D2 wherein D1 is less than D2. In fact, it has a tapered central portion as shown. While this is generally smooth and arcuated, it could be abrupt or it could be at right angles and still function within the scope of the present invention. Thus, wheel 13 has a smaller diameter 41 and a greater outer diameter 43. This holds the corner of the corner bead strip in place as its being pulled through tool 1.

Figure 6:
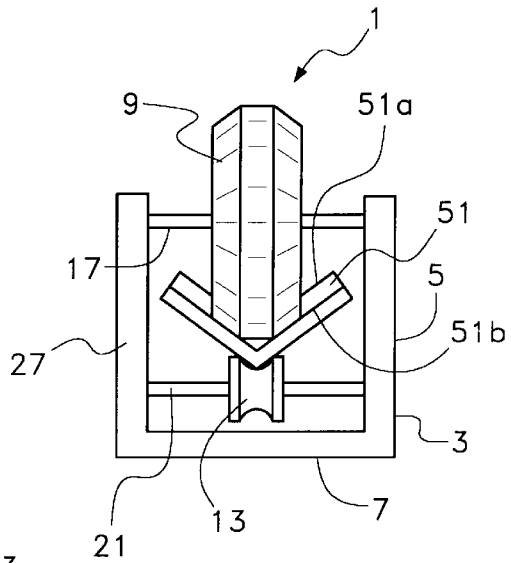
FIGS. 5 and 6 show side and front views of the present invention tool with a corner bead being pulled therethrough to create a wider corner angle; and, FIG. 7 illustrates a side view of an alternative embodiment present invention tool with multiple rollers.
Figure 5:
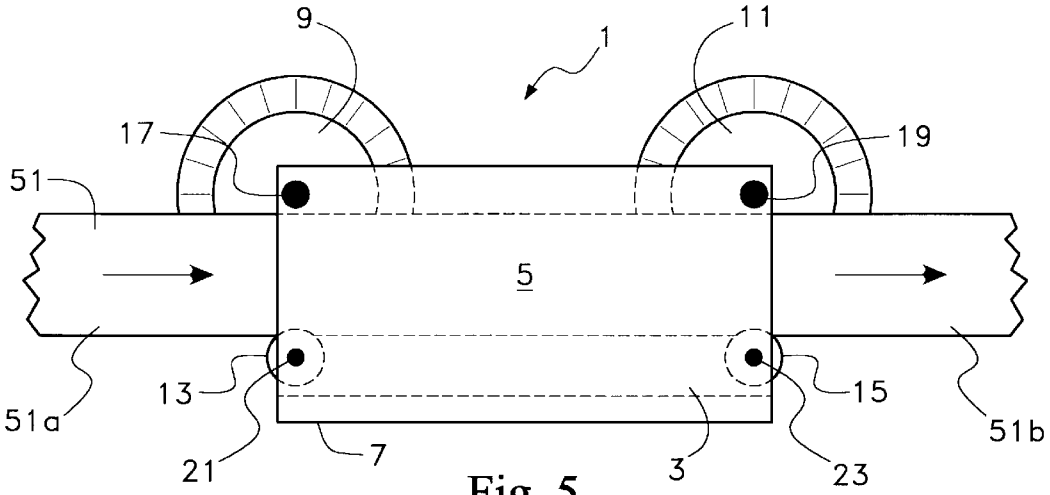

Referring now to FIGS. 5 and 6, the device shown in FIGS. 1 and 2 is re-presented but, in this case, corner bead 51 is shown being pulled through from left to right in accordance with the arrows shown in FIG. 5. By using at least two sets of spreader wheels and two sets of corner holding wheels, there is a continuous, straight, fixed spreading of corner bead strip 51 and FIG. 6 illustrates this widening such that end 51A going into device 1 has a 90° and end 51B has a broader angle, in this case, 135° or approximately 135°.

It is the nature of wall board construction that corner beads should be ever so slightly less than the actual angles so that a 90° corner bead may in fact be 88° or 87° or 89° and, likewise, 135° spread corner might be 133° or some other close angle. Therefore, when the angles are recited in this application and claims, it should be understood that they are approximate and the "play" utilized throughout the industry shall apply.

Figure 7:
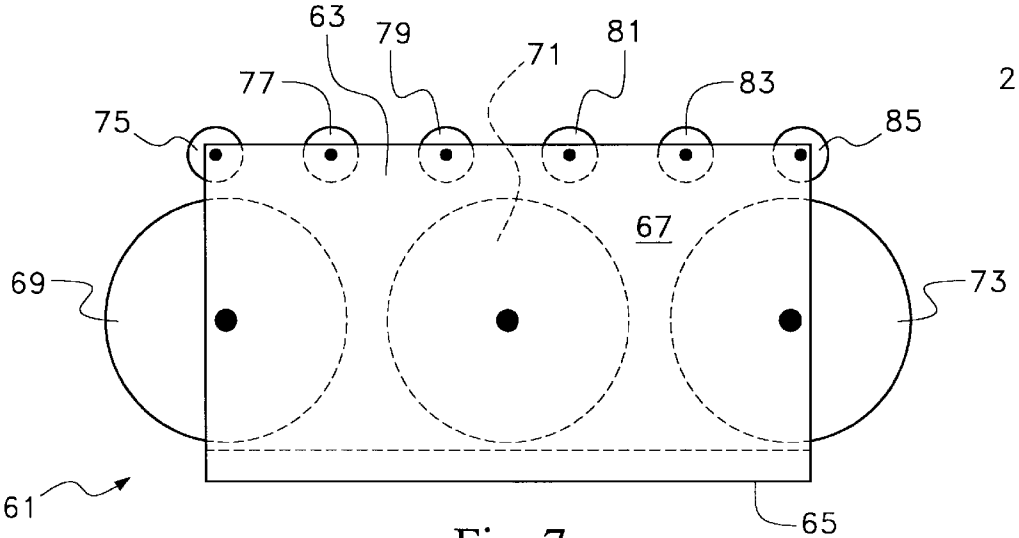

FIG. 7 shows a side view of an alternative present invention tool 61 wherein the spreader wheels 69, 71 and 73 are located below the corner holder wheels. In this case there are three spreader wheels and six corner holder wheels. These wheels being wheels 75, 77, 79, 81, 83 and 85. Main frame 63 has a side wall 67 and an opposite side wall not shown, as well as a bottom 65. Although in all of the embodiments, the spreader wheels and the corner holder wheels are in the same plane, in the device shown in FIG. 5, they are in matched pairs directly above one another whereas in the device 61 shown in FIG. 7, they are staggered. Here, in FIG. 7, there are twice as many corner holder wheels and this is a matter of design. However, by using three spreader wheels and six corner holder wheels, the spreading of a corner bead strip is distributed over more surface area and is believed to therefore be easier to work through the device. Nonetheless, it is been found that single sets of wheels do not work well and create irregularities. Also, it has been found in the development of this invention that feeder devices without the holding wheels create such friction that they are virtually inoperable or very difficult to operate. Therefore, it has been surprisingly and unexpectedly discovered that the configurations described above and set forth in this invention work far more superior to those which have been developed over the past five years or so.

Obviously, numerous modifications and variations of the present invention are possible in light of the above teachings. It is therefore understood that within the scope of the appended claims, the invention may be practiced otherwise than as specifically described herein.

What is claimed is:

1. A tool for manually altering the angle of a sheetrock corner bead strip from approximately 90° to an angle larger than 90°, which comprises:

(a) a main frame having at least a base and opposing side walls, said main frame adapted to receive and hold axles for at least two spreader wheels and at least two corner holder wheels;

(b) at least two spreader wheels with axles, said axles being mounted in series alignment with one another for rotation of said spreader wheels; and, (c) said at least two spreader wheels having walls which form truncated V-shaped sides for maintaining a sheetrock corner bead strip at a predetermined angle within said tool;

(d) at least two corner holder wheels with axles, said axles being mounted in series alignment with one another for rotation of said corner holder wheels; and, wherein said at least two spreader wheels and said at least two corner holder wheels are all located in a single plane.

2. The tool of claim 1 wherein said predetermined angle is approximately 135° and said truncated V-shaped sides form an angle of approximately 135°.

3. The tool of claim 1 wherein said corner holder wheels have a variable diameter such that its center diameter is less than its maximum diameter.

4. The tool of claim 2 wherein said corner holder wheels have a variable diameter such that its center diameter is less than its maximum diameter.

5. The tool of claim 1 wherein there are an equal number of spreader wheels and corner holder wheels and they are located in pairs with each spreader wheel being adjacent a corner holder wheel.

6. The tool of claim 1 wherein there are at least twice as many corner holder wheels as spreader wheels.

7. The tool of claim 6 wherein said spreader wheels have walls which form truncated V-shaped sides for maintaining a sheetrock corner bead strip at a predetermined angle within said tool.

8. The tool of claim 7 wherein said predetermined angle is approximately 135° and said truncated V-shaped sides form an angle of approximately 135°.

9. The tool of claim 6 wherein said corner holder wheels have a variable diameter such that its center diameter is less than its maximum diameter.

10. The tool of claim 7 wherein said corner holder wheels have a variable diameter such that its center diameter is less than its maximum diameter.

11. The tool of claim 1 wherein said main frame is of a generally U-shaped end view configuration and is unistructurally formed.

12. The tool of claim 1 wherein said wheels are formed of metal.

13. The tool of claim 1 wherein said wheels are formed of plastic.

14. The tool of claim 1 wherein said spreader wheels are removable and interchangeable with spreader wheels of different angles.

* * * * *